US009053897B2

(12) United States Patent
Kraft et al.

(10) Patent No.: US 9,053,897 B2
(45) Date of Patent: Jun. 9, 2015

(54) ANODE DISK ELEMENT WITH REFRACTORY INTERLAYER AND VPS FOCAL TRACK

(75) Inventors: Kevin Charles Kraft, Plainfield, IL (US); Ming-Wei Paul Xu, Oswego, IL (US); Min He, Downers Grove, IL (US); Gerald James Carlson, Aurora, IL (US)

(73) Assignee: Koninklijke Philips N.V., Eindhoven (NL)

( * ) Notice: Subject to any disclaimer, the term of this patent is extended or adjusted under 35 U.S.C. 154(b) by 10 days.

(21) Appl. No.: 13/991,427

(22) PCT Filed: Dec. 14, 2011

(86) PCT No.: PCT/IB2011/055656

§ 371 (c)(1),
(2), (4) Date: Jun. 4, 2013

(87) PCT Pub. No.: WO2012/080958

PCT Pub. Date: Jun. 21, 2012

(65) Prior Publication Data

US 2013/0259205 A1 Oct. 3, 2013

Related U.S. Application Data

(60) Provisional application No. 61/423,690, filed on Dec. 16, 2010.

(51) Int. Cl.
*H01J 35/10* (2006.01)
*H01J 35/08* (2006.01)
(Continued)

(52) U.S. Cl.
CPC ..... *H01J 35/105* (2013.01); *H01J 35/10* (2013.01); *H01J 35/08* (2013.01); *H01J 35/12* (2013.01); *H01J 9/02* (2013.01); *H01J 35/108* (2013.01); *H01J 2235/081* (2013.01); *H01J 2235/084* (2013.01)

(58) Field of Classification Search
CPC ..... H01J 35/108; H01J 35/08; H01J 35/10; H01J 35/12; H01J 35/105; H01J 2235/08; H01J 2235/081; H01J 2235/083; H01J 2235/084; H01J 2235/085; H01J 2235/088; H01J 2235/1229; H01J 2235/1233; H01J 2235/1241; H01J 2235/1291; H01J 2235/1295
USPC ..... 378/119, 121, 125, 127–129, 141–144
See application file for complete search history.

(56) References Cited

U.S. PATENT DOCUMENTS

| | | | |
|---|---|---|---|
| 3,731,128 | A | 5/1973 | Haberrecker |
| 3,890,521 | A | 6/1975 | Shroff |
| 3,979,267 | A | 9/1976 | Townsend |

(Continued)

OTHER PUBLICATIONS

G.W. Melors et al., "Electrodeposition of Coherent Deposits of Refractory Metals", Journal of the Electrochemical Society, vol. 112, No. 3, Jan. 1, 1965, pp. 266-272.

*Primary Examiner* — Anastasia Midkiff

(57) ABSTRACT

An anode (30) is formed by building a carbon, such as a carbon reinforced carbon composite, or other ceramic substrate (50). A ductile, refractory metal is electroplated on the ceramic substrate to form a refractory metal carbide layer (52) and a ductile refractory metal layer (54), at least on a focal track portion (36). A high-Z refractory metal is vacuum plasma sprayed on the ductile refractory metal layer to form a vacuum plasma sprayed high-Z refractory metal layer (56), at least on the focal track portion.

15 Claims, 2 Drawing Sheets

(51) Int. Cl.
*H01J 35/12* (2006.01)
*H01J 9/02* (2006.01)

(56) References Cited

U.S. PATENT DOCUMENTS

| | | | | | |
|---|---|---|---|---|---|
| 4,178,413 | A | * | 12/1979 | DeMunda | 428/408 |
| 4,777,643 | A | | 10/1988 | Devine, Jr. | |
| 4,972,449 | A | | 11/1990 | Upadhya et al. | |
| 5,159,619 | A | * | 10/1992 | Benz et al. | 378/143 |
| 5,204,891 | A | | 4/1993 | Woodruff et al. | |
| 5,414,748 | A | * | 5/1995 | Upadhya | 378/144 |
| 6,132,812 | A | * | 10/2000 | Rodhammer et al. | 427/446 |
| 6,390,875 | B1 | * | 5/2002 | Warren et al. | 445/28 |
| 6,430,264 | B1 | | 8/2002 | Lee | |
| 8,153,528 | B1 | * | 4/2012 | Hendler et al. | 438/697 |
| 2003/0058995 | A1 | | 3/2003 | Kutschera et al. | |
| 2004/0234041 | A1 | * | 11/2004 | Artig et al. | 378/203 |
| 2005/0158468 | A1 | * | 7/2005 | Gaffney et al. | 427/249.1 |
| 2009/0086920 | A1 | * | 4/2009 | Lee et al. | 378/144 |
| 2010/0040202 | A1 | * | 2/2010 | Lee | 378/143 |
| 2010/0284520 | A1 | | 11/2010 | Reis et al. | |
| 2011/0249803 | A1 | * | 10/2011 | Drory | 378/125 |

* cited by examiner

ANODE DISK ELEMENT WITH REFRACTORY INTERLAYER AND VPS FOCAL TRACK

The present application relates to the radiographic arts. It finds particular application in conjunction with rotating anode x-ray tubes and will be described with particular reference thereto.

Rotating anode x-ray tubes include a disk-shaped refractory metal target whose properties include high temperature, high strength, good thermal conductivity, and good heat capacity. Rotating anodes in x-ray devices are subject to large mechanical stresses from anode rotation, and in CT scanners, from gantry rotation. Additionally, the anodes are stressed due to thermal-mechanical stresses caused by the x-ray generation process. X-rays are generated by electron bombardment of the anode's focal track which heats a focal spot to a sufficiently high temperature that x-rays are emitted. A majority of the energy applied to the focal spot and the anode surface is transformed into heat which must be managed. The localized heating of the focal spot due to the electron bombardment is a function of the target angle, the focal track diameter, the focal spot size, rotating frequency, power applied, and metal properties (such as thermal conductivity, density, and specific heat). Focal spot temperatures and thermal-mechanical stresses are managed by controlling the above-discussed variables. X-ray tube protocols are limited by the ability to modify these variables stemming from material property limitations.

Refractory metal anode disk x-ray tubes are limited by the mechanical properties of the substrate material, as well as by the ability of the material to remove heat from the localized volume adjacent the focal spot. It has been proposed to replace the refractory metal substrate with a carbon-fiber reinforced carbon (CFC) composite rotating anode. CFC anodes create an opportunity to customize the matrix to maximize the mechanical strength of the substrate material. However, there is still an issue with the ability to remove the localized heat from the focal spot and the focal track.

For example, it has been proposed to use chemical vapor deposition (CVD) of tantalum (Ta) to create a tantalum carbide (TaC) layer on the CFC composite substrate followed by CVD of tungsten (W) or tungsten-rhenium (W—Re) to form the focal track. This process is not only expensive, but it also has reliability issues. Chemical vapor deposition forms a columnar metallurgical structure, analogous to blades of grass. When such structure starts to crack or fail, cracks propagate readily through the columnar structure to the carbon substrate, ruining the x-ray tube.

The present application describes a combination of electrolytic plating and vacuum plasma spraying to create a CFC substrate anode which overcomes the noted problems, and others.

In accordance with one aspect, an anode includes a carbon or ceramic substrate. A refractory metal carbide layer coats at least a focal track portion of the substrate. A ductile refractory metal layer coats the carbide layer, at least on the focal track portion. A vacuum sprayed high-Z refractory metal layer coats the ductile refractory metal layer, at least on the focal track portion.

In accordance with another aspect, an x-ray tube is provided which includes a vacuum envelope, the anode described in the preceding paragraph, a motor for rotating the anode, and a cathode.

In accordance with another aspect, an imaging apparatus is provided including a gantry, the x-ray tube described in the preceding paragraph, and a radiation detector mounted to the gantry across an examination region from the x-ray tube.

In accordance with another aspect, a method of manufacturing the above-discussed anode is provided. The carbon or ceramic substrate is built and electroplated with a ductile refractory metal to form the carbide layer and the ductile metal layer, at least on the focal track portion. At least the focal track portion is vacuum plasma sprayed with a high-Z metal to form the vacuum plasma sprayed high-Z refractory metal layer.

In accordance with another aspect, a method of using the above-discussed anode is provided. The anode is rotated and electrons are emitted with a cathode. A DC potential is applied between the cathode and anode to accelerate the electrons to impact the anode and generate x-rays.

One advantage resides in a superior metallurgical composition of the focal track.

Another advantage resides in its cost-effectiveness.

Another advantage resides in a light weight anode which has the properties of high temperature, high strength, good thermal conductivity, and good heat capacity.

Still further advantages of the present invention will be appreciated to those of ordinary skill in the art upon reading and understand the following detailed description.

The invention may take form in various components and arrangements of components, and in various steps and arrangements of steps. The drawings are only for purposes of illustrating the preferred embodiments and are not to be construed as limiting the invention.

Figure 1:
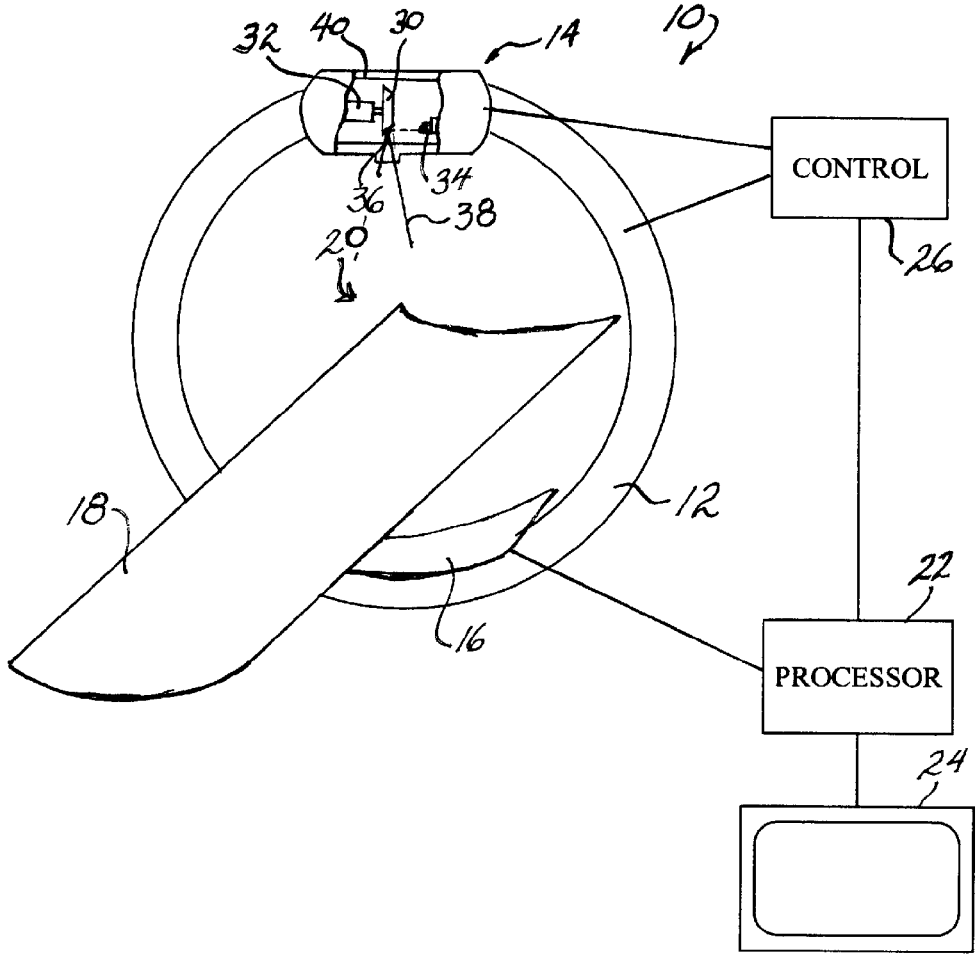
FIG. 1 is a diagrammatic illustration of a medical diagnostic imaging system.

With reference to FIG. 1, a diagnostic imaging system 10 includes a gantry 12 which carries an x-ray or gamma-ray tube 14 and an x-ray or gamma-ray detector 16. A patient support 18 is disposable in an examination region 20 disposed between the x-ray or gamma-ray tube 14 and the detector 16. In one embodiment, the medical diagnostic imaging system includes a CT scanner in which the gantry 12 along with the tube 14 and the detector 16 rotates around the examination region 20. In another embodiment, the gantry 12 is a C-arm assembly which is selectably positionable and/or rotatable around a subject disposed on the subject support 18. In another embodiment, the tube and detector are part of a dental x-ray system. Still other embodiments including inspection systems, are also contemplated.

A processor 22 receives electronic data from the detector 16 and processes it, e.g., reconstructs the data into diagnostic images, into appropriate format for display on a monitor 24. A control 26 is operated by a clinician to select the operating parameters of the tube, detector, and processor and control the generation of diagnostic images.

The x-ray or gamma-ray tube 14 includes a rotating anode 30 mounted by a shaft to a motor 32 which can cause the anode to rotate at high speeds. A cathode 34, such as a heated filament, emits a beam of electrons which are accelerated by a high electrical potential (the electrical potential source is not shown) to impinge upon a focal track 36 of the anode and emit a beam of x- or gamma-rays 38. The anode and cathode are disposed in a vacuum jacket 40.

Figure 2:
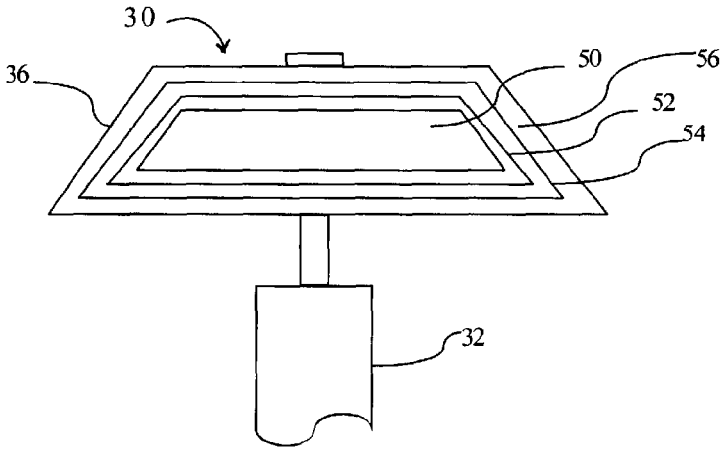
FIG. 2 is a detailed cross-sectional view of the rotating anode of FIG. 1.

With reference to FIG. 2, the anode 30 includes a light weight substrate 50, such as a carbon fiber reinforced carbon composite, a carbon composite, graphite ceramic matrix, or the like. A refractory metal carbide layer 52, formed of an IV B, V B, or VI B refractory metal, coats at least the focal track face of the substrate 50. In some embodiments, the entire substrate is encased in the carbide layer. In the illustrated embodiment, the carbide layer forms at an interface between the substrate and an electrolytically plated ductile refractory layer 54. The ductile refractory metal reacts with the carbon until the carbon is shielded from the ductile refractory layer by the carbide layer, e.g., about a thickness of a carbide molecule. The electrolytically plated ductile refractory metal layer 54 covers the carbide layer, at least on the focal track 36. The ductile refractory layer is again a IV B, V B, or VI B metal. Typical metals include niobium (Nb), rhenium (Re), tantalum (Ta), chromium (Cr), zirconium (Zr), and the like. The ductile layer has a thickness in the range of 0.13 mm (0.005 inches) to 0.50 mm (0.02 inches). In one embodiment, the ductile layer is 0.25 mm (0.01 inches) thick. In one embodiment, only the focal track 36 is plated with the ductile refractory metal. In another embodiment, due to the cost of trying to mask other regions of the substrate, the entire anode substrate is covered with the ductile layer. Optionally, there can be more than one layer of the ductile refractory metal plated on the surface, e.g., the metal can be changed after forming the carbide layer.

At least the focal track 36 is covered with a vacuum plasma sprayed (VPS) layer 56 of a high-Z refractory metal such as a tungsten-rhenium alloy. Other high-Z refractory metals such as tungsten, molybdenum, and the like are also contemplated. The high-Z refractory layer 56 has a thickness of 0.50 mm (0.02 inches) to 2.03 mm (0.08 inches). Thicker layers are also contemplated, but are more costly. Thinner layers tend to be more brittle and crack more readily.

Figure 3:
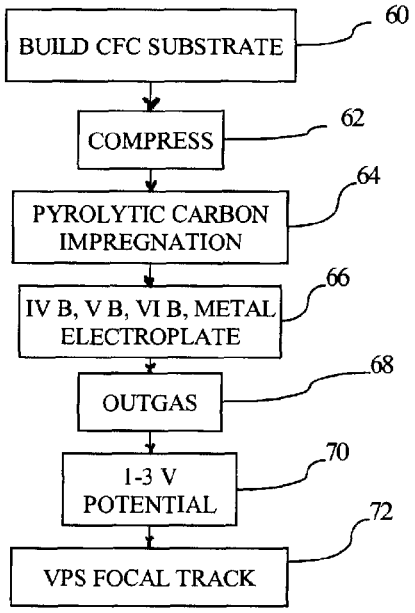
FIG. 3 is a flowchart illustrating the manufacturing process of the anode of FIG. 2.

With reference to FIG. 3, block 60 shows that the first step of manufacturing the anode 30 is building the light weight substrate 50, such as woven carbon fiber substrate, a carbon-fiber reinforced carbon composite, graphite, ceramic, or other light weight substrate. The substrate can then be densified such as by a compression process (block 62) and a pyrolytic carbon impregnation process (block 64).

Once the carbon-based anode substrate is complete, at least the focal track is electrolytically plated (block 66) with a high melting temperature metal, such as a group IV B, V B, or VI B metal, such as niobium, tantalum, chromium, zirconium, and the like to protect the substrate 50 during a vacuum plasma spraying step to follow. Niobium is advantageous because it facilitates electroplating. Tantalum may also be advantageous. To avoid the cost of masking, the entire substrate 50 can be electrolytically plated. Electrolytic plating with the high melting temperature metal may include, for example, electroplating the disk in such as a mixture of niobium fluoride ($NbF_5$), an alkaline fluoride mixture (NaF+KF), and an alkaline earth fluoride ($CaF_2$) at a temperature 10° C. or more above the mixture's melting point but below 600° C. During the plating process, the melt, the electrolytic plating bath and any substrate being electrolytically plated, is outgassed (block 68) at a pressure of about ⅓ atmosphere, and the anode is maintained at a positive potential (block 70), e.g., about 1-3 volts, relative to the melt. During the electrolytic plating process, the niobium or other refractory metal initially forms the thin carbide layer 52 and then forms the ductile metal layer 54. Optionally, a first refractory metal may be electrolytically plated to form the carbide layer and a different ductile refractory metal can be electrolytically plated to form all or part of the ductile metal layer. Again, the thickness of the ductile metal and carbide layers combined is about 0.25 mm (0.01 inches) but may range, for example, from 0.13-0.50 mm (0.005-0.020 inches).

In a vacuum plasma spraying operation (block 72), at least the focal track 36 is vacuum plasma sprayed with a high-Z refractory metal, such as a tungsten-rhenium alloy. During the vacuum plasma spraying, only regions of the substrate 50 which have been plated with the ductile refractory metal layer 54 are vacuum plasma sprayed. Vacuum plasma spraying sprays the high-Z refractory metal with sufficient force that it would damage the substrate 50 if it were sprayed directly on the substrate. The ductile refractory layer 54 protects the substrate during the vacuum plasma spraying of the focal track. The ductile layer also provides a ductile transition between the substrate 50 and the high-Z refractory metal focal track which ductile matches the thermal expansion coefficients of the high-Z refractory metal and the substrate. The ductile layer can also accommodate a small mismatch in the thermal expansion coefficients. The carbide layer 52 also blocks the carbon from migrating from the substrate into the high-Z refractory metal. Again, the vacuum plasma spraying provides a high-Z refractory metal layer 56 of 0.50-2.03 mm (0.02 to 0.08 inches), preferably 1.00 to 1.52 mm (0.04-0.06 inches). Other thicknesses are also contemplated. Vacuum plasma spraying a thicker layer is possible but more costly. As the vacuum plasma sprayed high-Z refractory metal becomes thinner, it has a greater tendency to crack. Vacuum plasma spraying is advantageous due to its speed, low cost, and in the formation of a layered microstructure in the high-Z refractory metal layer 56.

The invention has been described with reference to the preferred embodiments. Modifications and alterations may occur to others upon reading and understanding the preceding detailed description. It is intended that the invention be constructed as including all such modifications and alterations insofar as they come within the scope of the appended claims or the equivalents thereof.

Having thus described the preferred embodiments, the invention is now claimed to be:

1. An anode including:

a carbon or ceramic substrate;

an electrolytically plated refractory metal carbide layer coating at least a focal track portion of the substrate;

an electrolytically plated ductile refractory metal layer coating the carbide layer at least on the focal track portion; and a vacuum plasma sprayed high-Z refractory metal layer coating the ductile refractory metal layer at least on the focal track portion.

2. The anode according to claim 1, wherein the vacuum plasma sprayed high-Z refractory layer is a tungsten-rhenium alloy.

3. The anode according to claim 1, wherein the ductile refractory metal layer includes niobium and the refractory metal carbide layer includes a niobium carbide.

4. An x-ray tube comprising:

a vacuum envelope;

the anode according to claim 1;

a motor for rotating the anode; and a cathode.

5. An imaging apparatus comprising:

a gantry;

the x-ray tube according to claim 4 mounted to the gantry; and a radiation detector mounted to the gantry and disposed across an examination region from the x-ray tube.

6. The diagnostic imaging device according to claim 5, further including:

a processor connected with the detector to process signals therefrom into an image representation; and a display device on which the image representation is displayed.

7. A method of manufacturing an anode, the method comprising:

building a carbon or ceramic substrate;

electrolytically plating the substrate with a ductile refractory metal to form a refractory metal carbide layer;

electrolytically plating the refractory metal carbide layer with the ductile refractory metal to form a ductile refractory metal layer at least on a focal track portion; and vacuum plasma spraying at least the focal track portion with a high-Z refractory metal to form a vacuum plasma sprayed high-Z refractory metal layer.

8. The method according to claim 7, further including:

compressing the carbon or ceramic substrate; and performing a pyrolytic carbon impregnation on the substrate.

9. The method according to claim 7, wherein in the electroplating step, the ductile refractory metal is selected from groups IV B, V B, or VI B.

10. The method according to claim 7, wherein the ductile refractory metal includes niobium.

11. The method according to claim 10, wherein the electroplating includes electroplating the substrate with a mix of niobium fluoride, an alkaline fluoride mixture, and an alkaline earth fluoride at a temperature between 10° C. above a melting point of a salt bath and below 600° C.

12. The method according to claim 7, wherein the vacuum vapor sprayed high-Z refractory metal includes a tungsten-rhenium alloy.

13. The method according to claim 7, wherein the ductile metal electroplating step includes creating a layer 0.13 mm (0.005 inches) to 0.50 mm (0.02 inches) of the ductile refractory metal.

14. The method according to claim 7, wherein the plasma spraying step produces a layer of 1.00-1.52 mm (0.04-0.06 inches) thick layer of the high-Z refractory metal.

15. A method of manufacturing an anode, the method comprising:

forming a carbon substrate including carbon fibers;

compressing and pyrolytically impregnating the substrate to increase a density of the substrate;

electrolytically plating the substrate with a ductile refractory metal initially forming is ductile refractory metal carbide layer and subsequently forming a carbide free ductile refractory metal surface layer;

outgassing the electrolytically plated substrate; and vacuum plasma spraying at least a focal track of the anode with a high-Z refractory metal to form a 0.5-2.03 mm ductile high-Z refractory metal layer on at least the focal track.

* * * * *